US008192332B2

(12) United States Patent
Baker et al.

(10) Patent No.: US 8,192,332 B2
(45) Date of Patent: Jun. 5, 2012

(54) ENERGY ABSORBING SUSPENSION EQUIPMENT (EASE) FOR ROWING MACHINES

(75) Inventors: David Gardner Baker, Shrewsbury, MA (US); Patrick Michael Guida, West Boylston, MA (US); Laurie A. Smith, Billerica, MA (US); Michael D. Ryan, Upton, MA (US)

(73) Assignee: Blackstone Automation, LLC, Shrewsbury, MA (US)

( * ) Notice: Subject to any disclaimer, the term of this patent is extended or adjusted under 35 U.S.C. 154(b) by 242 days.

(21) Appl. No.: 12/459,015

(22) Filed: Jun. 26, 2009

(65) Prior Publication Data

US 2010/0190615 A1 Jul. 29, 2010

Related U.S. Application Data

(60) Provisional application No. 61/146,829, filed on Jan. 23, 2009.

(51) Int. Cl.
*A63B 69/06* (2006.01)
*A63B 22/00* (2006.01)
*A63B 21/00* (2006.01)

(52) U.S. Cl. ..... 482/72; 482/51; 482/133

(58) Field of Classification Search ..... 482/1, 8, 482/51, 72, 73, 900; 434/247
See application file for complete search history.

(56) References Cited

U.S. PATENT DOCUMENTS 199,432 A * 1/1878 Goldie ..... 482/72
335,597 A * 2/1886 Libbey ..... 482/72
2,183,345 A * 12/1939 Brandon ..... 482/72
2,565,615 A * 8/1951 McCoy ..... 33/370
3,324,815 A * 6/1967 Morales ..... 114/275
3,586,322 A * 6/1971 Kverneland ..... 482/72
4,396,188 A 8/1983 Dreissigacker et al.
4,650,181 A * 3/1987 Yang ..... 482/73
4,743,011 A 5/1988 Coffey
4,772,013 A 9/1988 Tarlow, Jr.
4,875,674 A 10/1989 Dreissigacker et al.
4,880,224 A 11/1989 Jonas et al.
4,884,800 A 12/1989 Duke
4,889,509 A * 12/1989 Pohlus ..... 440/105
5,122,105 A * 6/1992 Engel et al. ..... 482/72
5,382,210 A 1/1995 Rekers
5,441,469 A 8/1995 Chern
5,695,421 A * 12/1997 Fukuda ..... 474/82
5,762,584 A * 6/1998 Daniels ..... 482/5
5,779,600 A * 7/1998 Pape ..... 482/72
5,827,155 A * 10/1998 Jensen et al. ..... 482/54
6,527,676 B1 * 3/2003 Frick et al. ..... 482/51
6,602,168 B2 * 8/2003 Duke ..... 482/72

(Continued)

OTHER PUBLICATIONS www.concept2.com/us/undoorrowers/accessories/slides.asp.*

(Continued)

*Primary Examiner* — Loan Thanh
*Assistant Examiner* — Sandhara Ganesan

(57) ABSTRACT

A rowing machine or rowing machine attachment with an energy absorbing component configured to add responsive and compliant roll, pitch, and yaw motions to the rowing machine. The energy absorbing component is also configured to change shape so as to absorb energy in response to a compressive force by the user. Said energy absorption component returns substantially to its first shape in response to the removal of the compressive force. The energy-absorbing apparatus is configured to reduce a reaction force exerted on the user of the rowing machine.

20 Claims, 5 Drawing Sheets

U.S. PATENT DOCUMENTS

| | | | | |
|---|---|---|---|---|
| 6,991,589 | B1 | 1/2006 | Patterson | |
| 7,201,708 | B2 | 4/2007 | Dreissigacker et al. | |
| 7,270,630 | B1 | 9/2007 | Patterson | |
| 7,452,314 | B2 | 11/2008 | Mills et al. | |
| 7,731,637 | B2 * | 6/2010 | D'Eredita | 482/72 |
| 7,828,706 | B2 * | 11/2010 | Medina | 482/148 |
| 7,846,067 | B2 * | 12/2010 | Hanoun | 482/8 |
| 7,946,964 | B2 | 5/2011 | Gothro et al. | |
| 2003/0153437 | A1 * | 8/2003 | Tseng | 482/73 |
| 2005/0085348 | A1 * | 4/2005 | Kiefer et al. | 482/72 |
| 2005/0101450 | A1 * | 5/2005 | Gramaccioni | 482/72 |
| 2005/0170711 | A1 * | 8/2005 | Spencer et al. | 440/21 |
| 2007/0197347 | A1 * | 8/2007 | Roach | 482/72 |
| 2009/0181832 | A1 * | 7/2009 | Bell | 482/72 |

OTHER PUBLICATIONS www.coreperform.com.* www.rowbalance.com.* www.digitalrowing.com.* http://www.concept2.com/us/indoorrowers/monitors/pm4.asp, printed Jul. 14, 2011.

First EASE aftermarket device, Picture, Apr. 10, 2009.

Commercially available branded EASE aftermarket device Jun. 9, 2009.

EASE Marketing Sheet, Oct. 14, 2011.

* cited by examiner

ENERGY ABSORBING SUSPENSION EQUIPMENT (EASE) FOR ROWING MACHINES

CROSS-REFERENCE TO RELATED APPLICATIONS

Provisional Patent Application Ser. No. 61/146,829

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of Invention

Exercise Device 482/51, 72, 901

Conventional Indoor Rowing Machines (also referred to as "Ergometers" or "Ergs") generally consist of a horizontally translating seat on rollers 3 riding on a rigid frame 1, a resistance device (typically a rotary device) 4 connected to a pull handle 10 also mounted in-line to the seat on said frame. Foot mounts or stretchers 5 are also positioned appropriately on the rigid frame. The user secures his or her feet to the stretchers 5 and with his or her legs, back, arms, and hands, pulls via the handle on the resistance device to approximate forces on the body similar to the on-water rowing experience. These devices are widely used by the rowing community throughout the year typically with peak usage in colder months.

The Ergs are used for training and for measuring progress of rowers' conditioning as they train over the winter months. During the rowing season, Ergs are used to supplement on-water workouts to maximize conditioning. In addition, among the competitive rowing teams, the "Erg scores" are used as selection criteria of rowers for the fastest boats in various competitions. Also Erg scores are used for comparison of rowers across the country as part of the selection process for the national team boats. The standard used to measure erg scores is a static rowing machine. Thus, coaches need to be able to quickly and easily remove any and all rowing machine accessories and training aids from the rowing machine in order to accurately record and evaluate their rowers' erg scores. These Erg machines are also used by the non-rowing community for general fitness.

Conventional Ergs suffer from several deficiencies as compared to what is experienced in a rowing craft or boat (also referred to as a "Shell"):

- Boat side to side balance or Set
- Horizontal compliance (energy absorption) that is felt at either end of the stroke (oar entry or Catch, as shown in FIG. 1A and oar exit or Finish, as shown in FIG. 1B)
- Buoyant/vertical compliance (energy absorption) at the Catch and the Finish.

The present invention is an energy absorbing suspension for a rowing machine which addresses conventional erg deficiencies by simulating the on-water motions of a boat through the additions of responsive and compliant roll, pitch, and yaw motions throughout the entire rowing stroke (FIG. 1C).

Since a conventional erg does not offer roll, pitch, and yaw motions, the rower cannot train the same way on the land as on the water, where these motions impact rowing a shell as effectively as possible. When a shell pitches, the bow (front) and stem (rear) of the shell alternately move up and down in an angular motion in response to the rower movements at both the catch and the finish portions of the stroke. The smoother the rower's motions are at the center of rotation, in a plane along the center of the hull, the less pitching the shell will endure. Additionally, as the rower traverses back and forth along the hull, they attempt to do so with very little side-to-side (roll) motion. Rowing with good roll balance allows both oars to stay off the water during the recovery which reduces drag and also allows for optimum power when driving the oars through the water. When pressure is applied to the oars through the rower's push on the boat, even force from both sides of the body is necessary to keep the shell from turning (yawing) about its line of direction. As the shell yaws, a steering correction is required thus slowing the shell down. By minimizing all of these motions, through good rowing technique, the shell will move faster and more efficiently. Therefore, the adding of responsive roll, pitch, and yaw to the erg gives the rower greater opportunity to improve their rowing motion when they cannot be on the water.

2. Related Art

The rowing industry standard for Ergometers is the Concept2, manufactured by Concept2 in Morrisville, Vt. under U.S. Pat. Nos. 4,396,188, 4,875,674, 7,201,708. Numerous alternatives to this embodiment have been developed under such patents as U.S. Pat. Nos. 4,884,800, 4,880,224, 4,772,013, and 4,743,011. Most Ergs have been developed on a stationary frame. A significant drawback to the stationary frame is that it does not provide the energy absorbing downward motion that is experienced in an on-water rowing craft. Numerous studies have indicated that there are a variety of injuries suffered by rowers training on Ergometers ("Impact of Ergometer Design on Hip & Trunk Muscle Activity", Journal of Sports Science and Medicine, 2005, "Rowing: Injury Prevention and Management", Australian Institute of Sport).

In an effort to better simulate the on-water experience, the RowPerfect Ergometer, U.S. Pat. No. 5,382,210, was developed with frame and resistance elements that move with the rower in the horizontal direction. Additionally, Concept2 offers a slide as an accessory to their Ergometer to provide a similar horizontal motion. While the horizontal motion embodied in these two developments does improve the feel to a row on the water, they still do not provide any vertical energy absorption that the on-water experience also provides.

Another approach, U.S. Pat. Nos. 7,270,630, 6,991,589, attempts to maximize the exercise experience by varying the front and the back elevation of an Erg to provide an inclined path in both the drive and the recovery portion of the stroke. This design provides vertical movement but only as a fixed position not providing vertical compliance during the stroke.

U.S. Pat. No. 5,441,469(Chern) employs the use of two hydraulic cylinders mounted to a collapsible foot linkage in the rear of a sculling ergometer. In concert with this linkage are two rigid columns centrally mounted in line to the middle and front of the Erg frame. The purpose of this integrated Erg design is to provide a rocking motion at the rear of said machine that better simulates the on-water motion of a shell via the passive resistance of the hydraulic cylinder motion. While Chern offers roll throughout the stroke, pitch compliance is only provided at the finish (the rear of the Erg) since when the rower moves forward on said machine it rocks downward onto a rigid column at the catch. In contrast, the invention described herein provides responsive and compliant roll, pitch, and yaw motion throughout the entire stroke to any rigid frame rowing machine to better simulate the rowing motion one feels in a boat on the water.

Additional on-water experience add-on aftermarket devices have been designed for the Ergometer that simulate the side to side roll motion that is experienced when on the water. One such device is an adaptation to the Erg seat, Core Perform (U.S. Pat. No. 7,452,314), that provides compliance about the fore and aft, or drive axis of the Erg. Another embodiment of this approach is WILIS by Row Balance (U.S. Pat. No. 7,946,964) which features a pivot cradle that the Erg is placed in. This allows the entire Erg, not just the seat, to pivot about the drive axis also simulating the side to side motion experienced on the water. While these devices do provide roll motion, neither of these devices provide any compliance in either roll, pitch, or yaw and therefore offer no protection to the rower from the harshness of a rigid rowing machine.

Another invention that attempts to simulate the on-water experience, Yang (U.S. Pat. No. 4,650,181), offers two degrees of motion, in which Yang refers to as bowing and waving. The first motion is a responsive motion to the rowers movements, pitch compliance, through the use of cushioning springs and the other is a forced, rigid, roll motion through the use of uneven rails. Yang's central fulcrum stand constrains the motion of the base which in turn constrains the motions of the entire device and rower to pitch only by means of the cushioning springs. The second motion offered by Yang's invention is to forcibly roll the rower side to side by riding over the asymmetric, uneven rails of the base throughout the entire rowing motion to 'increase the player's interest'. Yang's forced roll motion makes it impossible for the rower to make the necessary neuromuscular compensations to attempt a smooth, balanced rowing stroke. Unlike the Yang invention, the EASE invention described here within responds to all of the rower's movements by giving proportional motion feedback in all three degrees of motion (roll, pitch, and yaw). This feedback from the EASE allows the rower to respond and correct their balance. Balanced posture throughout the rower's motion is one of the main objectives of proper rowing on the water.

BRIEF SUMMARY OF THE INVENTION

The invention described herein relates to an Energy Absorbing Suspension Equipment (hereinafter also referred to by the acronym "EASE") for use in conjunction with a rowing machine. In one embodiment, the energy-absorbing suspension equipment comprises an energy absorbing component, which is configured into an aftermarket device that is separate and removable from the rowing machine. The energy absorbing component has a first shape in the absence of a force applied by a user configured to change shape so as to absorb energy in response to application of a compressive force by the user and is configured to return to substantially its first shape in response to the removal of the compressive force. The EASE apparatus is configured to add responsive and compliant roll, pitch, and yaw motions to the rowing machine. The energy-absorbing suspension equipment also comprises a first locating structure configured to join the energy-absorbing suspension equipment to the rowing machine and a second locating structure configured to permit the energy-absorbing suspension equipment to be located on a rigid support. The energy-absorbing suspension equipment is configured to reduce a reaction force exerted on the user of the rowing machine. In one embodiment, the user does not need any tools to start using the EASE apparatus with the rowing machine as there is no assembly required and the rowing machine does not require any modifications.

In another embodiment, the energy-absorbing suspension equipment is integrated into a rowing machine which includes an energy absorbing component wherein the said energy absorbing component provides responsive and compliant roll, pitch, and yaw motions throughout the entire rowing stroke.

BRIEF DESCRIPTION OF THE SEVERAL VIEWS OF THE DRAWINGS

The forgoing and other objects, features, and advantages of the invention will be apparent from the following description of particular embodiments of the invention, as illustrated in the accompanying drawings in which like reference characters refer to the same parts throughout different views. The drawings are not necessarily to scale, emphasis being placed on illustrating the principles of the invention.

FIG. 2A illustrates the EASE aftermarket design in a detailed assembly with an Elastomeric energy absorbing embodiment.

DETAILED DESCRIPTION OF THE INVENTION

While it is conventional to operate such indoor rowing machines inside a structure, there is in principle no reason why such a rowing machine cannot also be used in the outdoors, for example in a location where there is no conveniently located body of water of sufficient size to permit rowing a boat on water.

As mentioned previously, mechanisms that address the deficiencies related to boat balance and horizontal compliance have been offered by several manufacturers. However, the combination of vertical energy absorption and side-to-side balance for both the finish and catch portions of the stroke has not been adapted to Erg designs for new machines or as after-market attachments for existing machines.

Figure 1A:
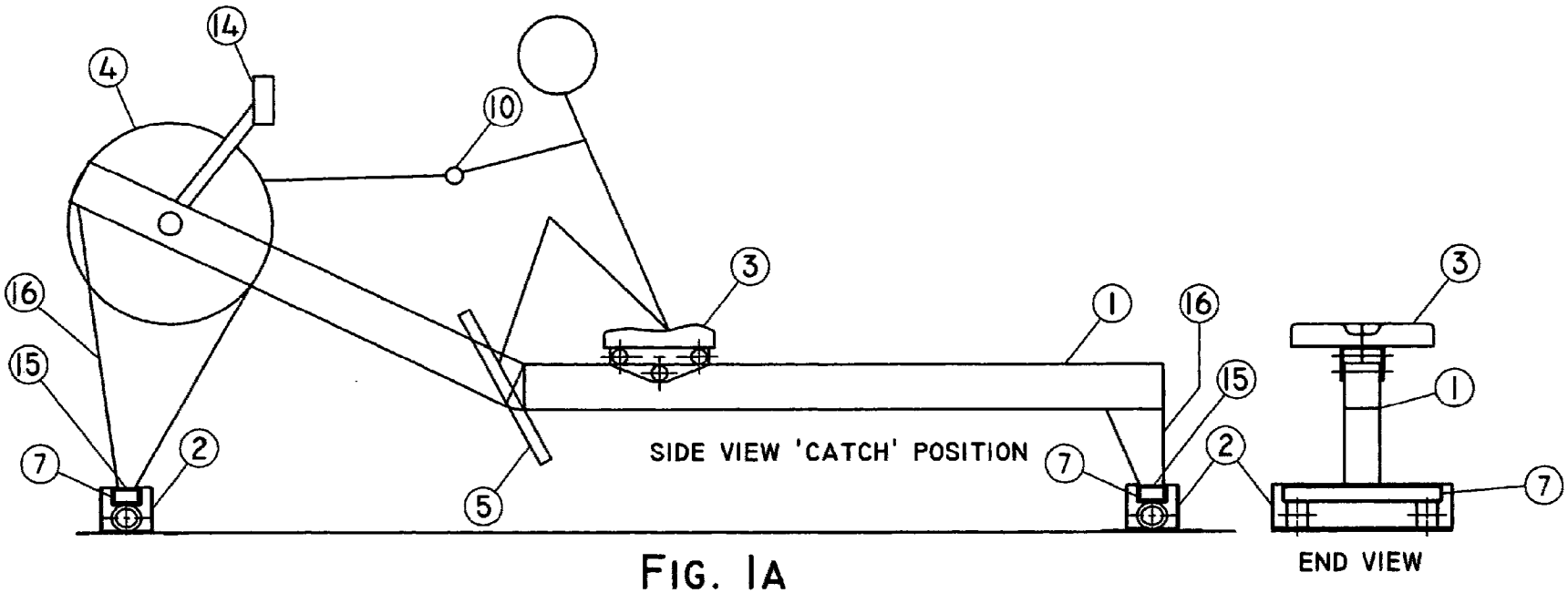
FIG. 1A shows an example of the rower in the 'catch' position using an existing Erg with an aftermarket embodiment of the EASE.

In the conventional Erg, the rower begins a stroke substantially in the position shown in FIG. 1A. The arms are extended and legs are sharply bent, the head and torso are tilted forward from the waist, and the seat is in a forward position, also known as the catch, in the boat. At the end of a stroke, the rower is substantially in the position shown in FIG. 1B. The arms are sharply bent and legs are extended, the head and the torso are tilted backward from the waist, and the seat is in a position that is rearward, also known as the finish, in the boat as compared to the seat position at the beginning of the stroke. As the rower finishes his or her stroke, the upper torso, head, and arms pivot about the lower back, so that the angular tilt of the head and torso are reversed, so as to be in the proper position to initiate the next stroke. This quick pivot results in an instantaneous change in acceleration or a jerk (which can be considered as a derivative of acceleration), of the upper body mass. A significant component of this jerk is seen as an axial compressive force on the rower's back. A similar jerk motion occurs with the catch portion of the stroke at the moment when the rower is forward, as in FIG. 1A, and begins to drive the resistance element of the Erg.

This jerk is a consequence of the fact that the Erg frame rests on a hard floor surface that provides little or no energy absorption, nor does it allow motion as is experienced in a waterborne shell. Depending on the exercise goals of a user, it is common that one operates an Erg at a typical stroke rate in the range of 15 to 40 strokes per minute and Erg workouts ranging from 10 to 60 minutes in duration. Under such conditions, significant spinal compression can be experienced by the typical rower, which he or she would not be normally be subjected to in a rowing shell operated on water.

The EASE invention described herein provides the equivalent vertical energy absorption experienced by on-water rowers, for the indoor rower. Some of the benefits and advantages of adding an EASE mechanism to an Erg are:

A significant reduction in axial compression of the lower back, thereby reducing back pain and trauma at the finish.

A significant reduction in shear and tensile stresses on the knees, shoulders, and neck, thereby reducing pain in these key areas at the catch.

A more realistic on-water feel to an Erg at the finish and/or the catch positions.

In addition to building fitness, the increased on-water feel enhances the Erg experience by causing the rower to focus on improving rowing technique.

One embodiment of this invention, the EASE, can be provided as an aftermarket apparatus for a conventional Erg, as shown in FIG. 1A, FIG. 1B, FIG. 2A and FIG. 2B.

The following is a detailed description of the EASE function as it applies to the after-market design: The EASE 2 comprises a cradle 7 that locates and positions a foot 15 of the Erg leg 16 into the EASE 2. In some embodiments, the EASE is connected to a support member of the Erg, such as a back foot or a front foot. The cradle is attached to the energy absorbing components 9, which are in turn attached to the base enclosure 6. In some embodiments, the compliant motion of the EASE may be guided by such devices as rollers 8, slides, flexures, or any other guiding mechanisms as may be deemed necessary to control the lateral motion of the foot 15 of an Erg that operates with the EASE. The EASE is further connected to a rigid support, such as a floor or the ground. The connection can be as simple as a flat surface that provides a frictional connection to the rigid support, or it can be more complex, for example, a spike, a nut and bolt, a clamping mechanism, or some other structure configured to prevent relative motion between the EASE and the rigid support.

Figure 2B:
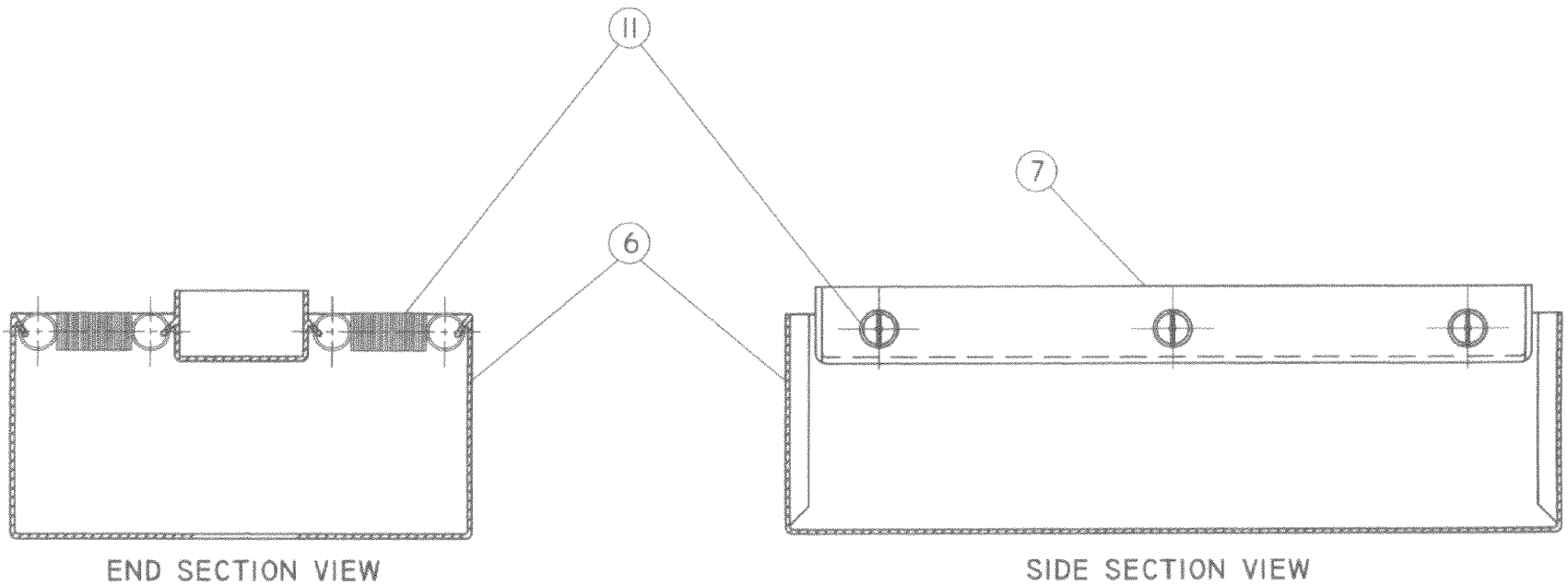
FIG. 2B illustrates the EASE aftermarket design in a detailed assembly with a typical spring energy absorbing embodiment.
Figure 3:
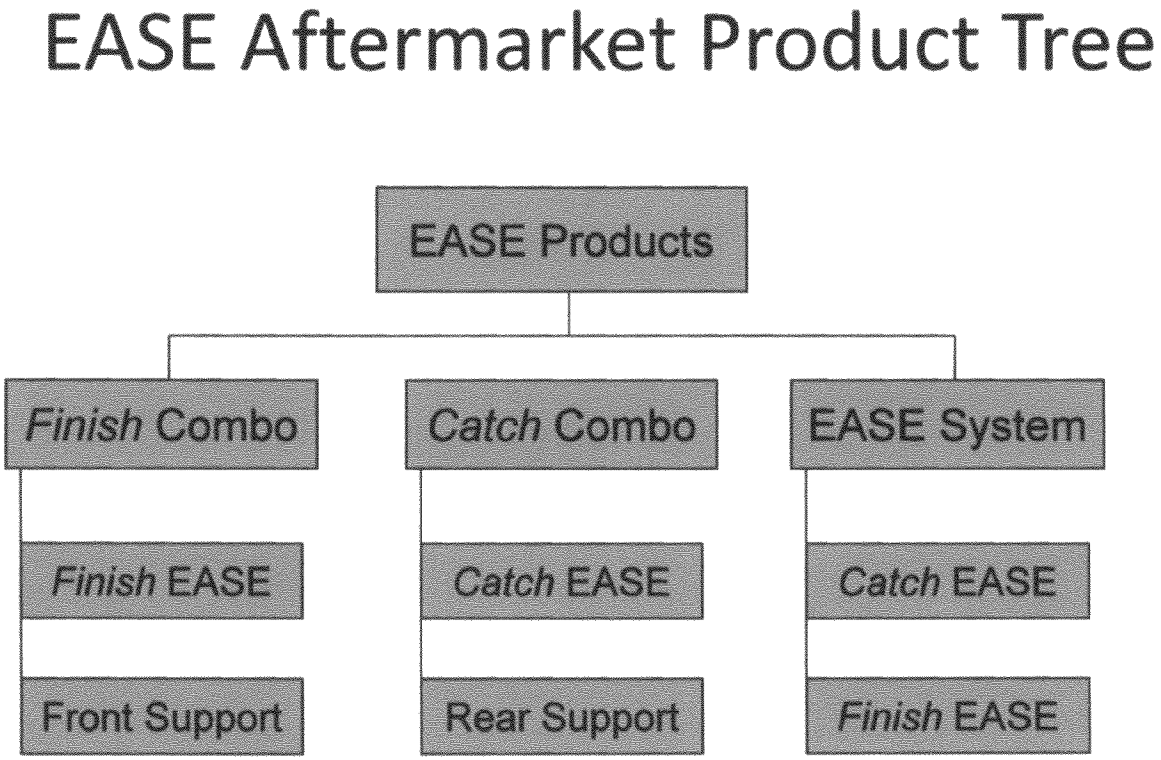
FIG. 3 is the EASE Aftermarket product tree. It illustrates possible combinations of the finish and catch EASE aftermarket apparatus with or without front or rear height supports to level the rowing machine.

In some embodiments, the energy absorbing components can include a variety of components such as elastomers of a variety of materials in tube, strip, o-ring form, or other configurations to suit the application. Alternately, the energy absorbing component can be provided in the form of one or more springs 11, as shown in FIG. 2B. The springs can be constructed of a variety of materials and can be provided in the form of coil springs, torsion springs, leaf springs, washers, or other geometrical variations to suit the application. In other embodiments, one can use a compressible fluid in an appropriate container. Alternatively, incompressible fluids in compliant containers could be used as an energy absorbing component in the EASE application. In yet other embodiments, one can use shock absorbers, resilient solid or foam shapes, gas springs, gas bladders, and other energy absorbing components of similar type. Composite energy absorbing components that can comprise any combination of solid, liquid, and/or gaseous materials can be deployed additionally to provide the appropriate compliant characteristics for the EASE. For example, in the case of an EASE that has a cylindrical shape as shown in FIG. 2A, the cylinder can be fabricated as a series of closely fitting cylinders of materials having different compliant properties. In some embodiments, the compliance of the energy absorbing components can be varied by replacing a component (such as a particular cylinder layer) with a cylinder layer of the same dimensions constructed from a material having different resilient or compliant properties.

Optionally, a second EASE aftermarket device 2 can be deployed on the front leg or legs of the Erg to provide compliance at the catch, as shown in FIG. 1A. When a plurality of EASE aftermarket devices 2 are used, they can be mounted to operate independently of each other or two or more can be linked to provide a desired effect on the Erg.

In some embodiments, a mechanism comprising a single piece of resilient material can be used. The single piece of an appropriate flexible material in a shape that can accept the Erg and is designed to yield the appropriate compliance and energy-absorbing characteristics needed.

Figure 1B:
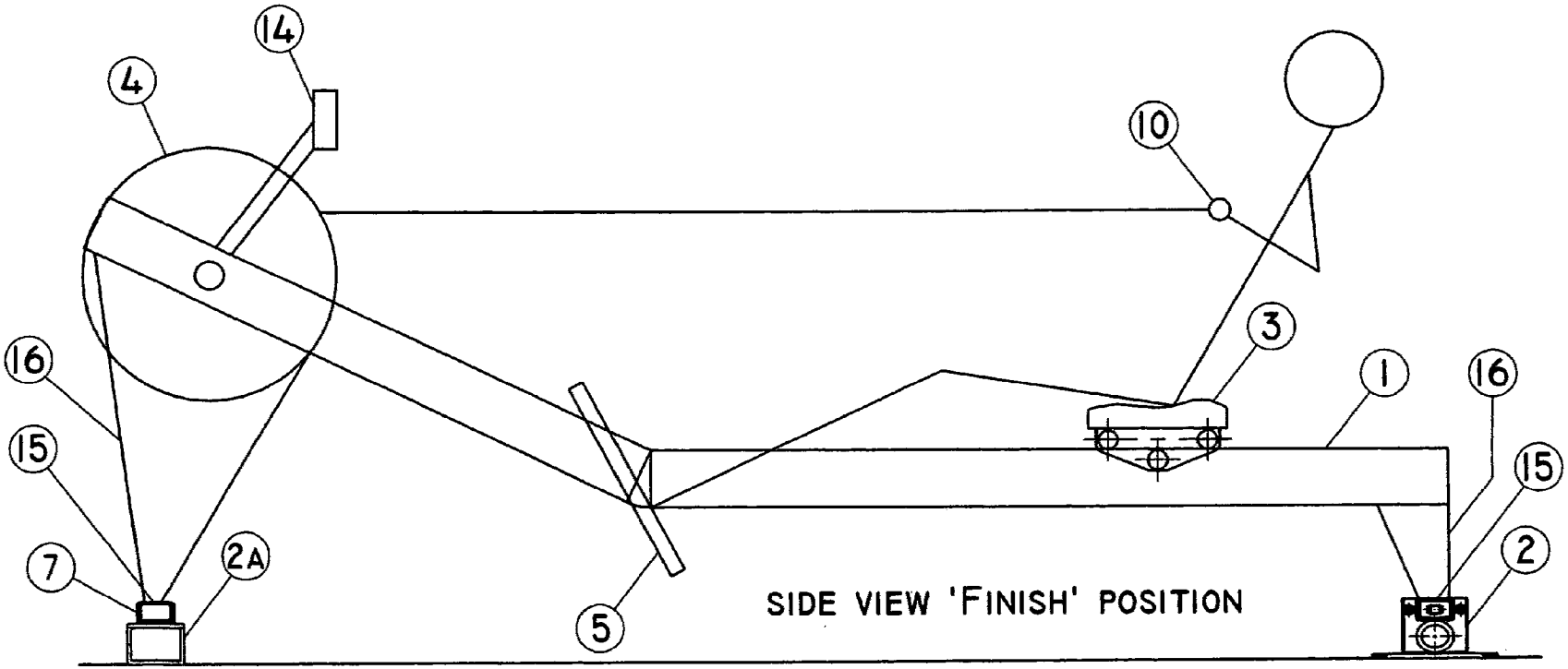
FIG. 1B shows the rower in the 'finish' position using an existing Erg with an aftermarket embodiment of the EASE.
Figure 1C:
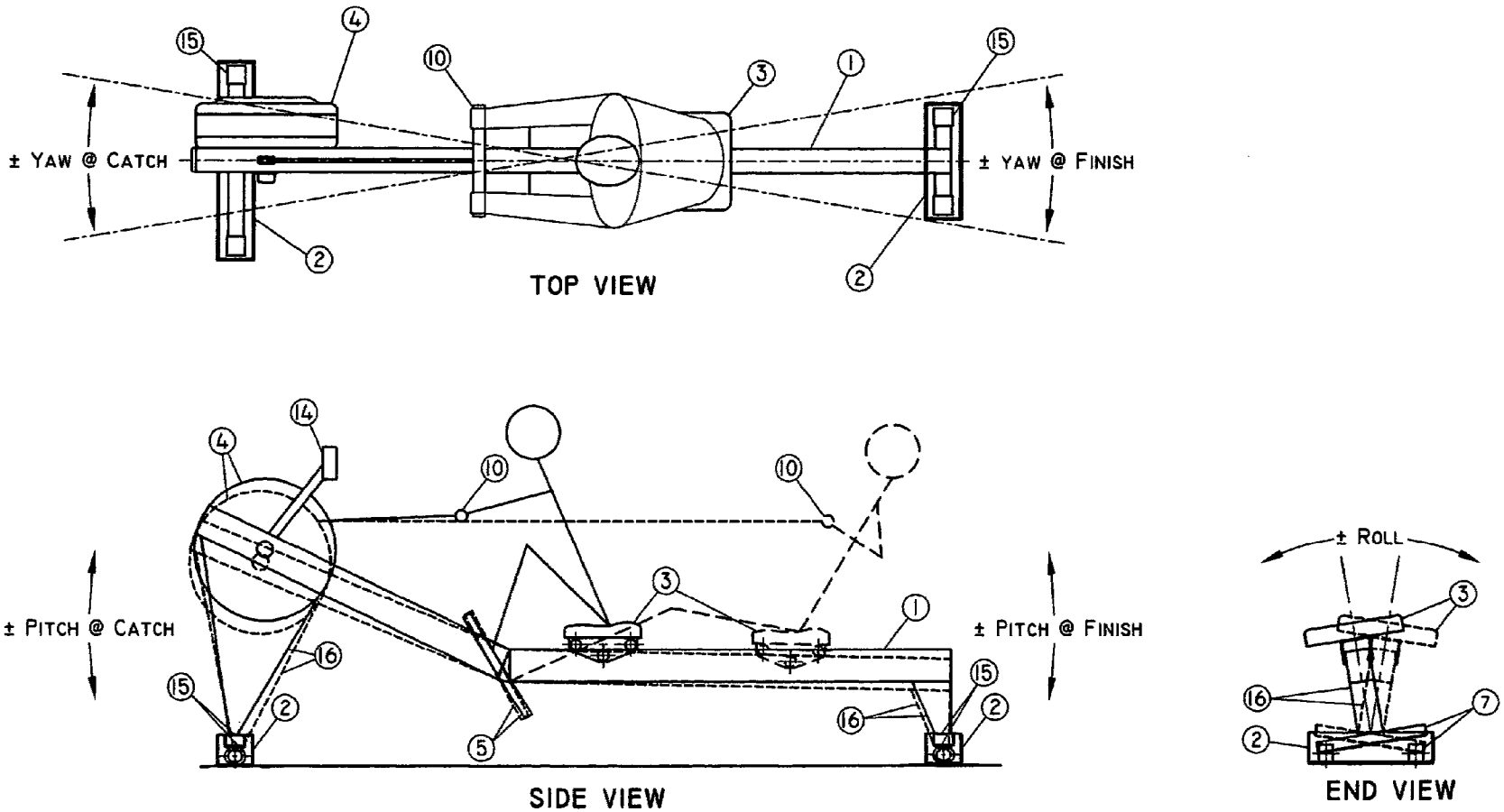
FIG. 1C shows the three degrees of motion (roll, pitch, and yaw) added to the rowing machine through the addition of the EASE aftermarket devices.

In another embodiment, an enclosure including a rigid front leg support in the form of a separate enclosure 2A, as shown in FIG. 1B, is used to level the rowing machine when an EASE aftermarket device is used on the rear of the rowing machine. To illustrate a further embodiment of this invention, F*ig*.3 illustrates possible combinations of the finish and catch EASE aftermarket apparatus with front or rear height supports. When the finish and catch EASE are deployed in the combination, neither the front nor rear supports are necessary. The finish and catch EASE aftermarket apparatus may also be used independently without the front or rear height supports.

The EASE design could be applied as an integral feature in an Erg as originally manufactured. In this case the EASE can be integrated into the leg sections, foot stretchers, or translating seat of the improved Ergometer design.

The invention claimed is:

1. An energy-absorbing suspension apparatus ("EASE") for use in conjunction with a rowing machine, comprising:

an energy absorbing component having a first shape in the absence of a force applied by a user, said energy absorbing component configured to change shape so as to absorb energy in response to application of a compressive force by the user, and configured to return to substantially its first shape in response to the removal of said compressive force;

wherein said energy absorbing component is configured into an aftermarket device that is separate and removable from said rowing machine;

wherein said energy absorbing suspension apparatus is configured to add responsive and compliant roll, pitch, and yaw motions to said rowing machine;

a first locating structure configured to join said energy-absorbing suspension apparatus to said rowing machine; and a second locating structure configured to permit said energy-absorbing suspension apparatus to be located on a rigid support;

whereby said energy-absorbing suspension apparatus is configured to reduce a reaction force exerted on a user of said rowing machine.

2. The energy-absorbing suspension apparatus of claim 1, whereby the motion on said rowing machine initiated by a rower begins at a forward position, the catch, then moves to a rearward position, the finish, and returns to a forward position, the catch.

3. The energy-absorbing suspension apparatus of claim 2, wherein said energy absorbing component is configured to simulate the behavior of a shell operated on water by adding responsive and compliant roll, pitch, and yaw motions throughout the entire rowing stroke.

4. One or more of said energy-absorbing suspension apparatus of claim 1, in combination with a rowing machine; each of said one or more energy-absorbing suspension apparatus joined with a support member of said rowing machine.

5. The energy-absorbing suspension apparatus of claim 1, in combination with a rowing machine and a non-energy-absorbing suspension apparatus, whereby said non-energy-absorbing suspension apparatus configured to level said rowing machine when used in combination with said energy-absorbing suspension apparatus.

6. The energy-absorbing suspension apparatus of claim 1, wherein said energy absorbing component comprises a selected one of an elastomer, a metal, a liquid, a gas, or a composite arrangement made from any combination of these material types.

7. The energy-absorbing suspension apparatus of claim 1, wherein said energy absorbing component comprises a shape selected from one of a tube, a strip, a foam, a ring, a coil spring, a leaf spring, a torsion spring, and a washer spring.

8. An energy-absorbing suspension apparatus ("EASE") integrated into a rowing machine, comprising:

an energy absorbing component having a first shape in the absence of a force applied by a user, said energy absorbing component configured to change shape so as to absorb energy in response to application of a compressive force by the user, and configured to return to substantially its first shape in response to the removal of said compressive force;

wherein said energy absorbing component provides responsive and compliant roll, pitch, and yaw motions throughout the entire rowing stroke; and whereby the motion on said rowing machine initiated by a rower begins at a forward position, the catch, then moves to a rearward position, the finish, and returns to a forward position, the catch;

whereby said energy-absorbing suspension apparatus is configured to reduce a reaction force exerted on a user of said rowing machine.

9. The energy-absorbing suspension apparatus of claim 8, wherein said energy absorbing component is configured to simulate the behavior of a shell operated on water.

10. The energy-absorbing suspension apparatus of claim 8, wherein said energy absorbing component comprises a selected one of an elastomer, a metal, a liquid, a gas, or a composite arrangement made from any combination of these material types.

11. The energy-absorbing suspension apparatus assembly of claim 8, wherein said energy absorbing component comprises a shape selected from one of a tube, a strip, a foam, a ring, a coil spring, a leaf spring, a torsion spring, and a washer spring.

12. The energy absorbing apparatus of claim 8 wherein said energy absorbing components are integrated into support members of said rowing machine.

13. The energy absorbing apparatus of claim 12 wherein said support members comprise the leg sections of said rowing machine.

14. An energy-absorbing suspension apparatus for use in conjunction with a rowing machine, comprising:

an energy absorbing component having a first shape in the absence of a force applied by a user, said energy absorbing component configured to change shape so as to absorb energy in response to application of a compressive force by the user, and configured to return to substantially its first shape in response to the removal of said compressive force;

wherein said energy absorbing component is configured into an aftermarket device that is separate and removable from said rowing machine;

wherein said energy absorbing suspension apparatus is configured to add responsive and compliant roll, pitch, and yaw motions to said rowing machine;

a first locating structure configured to place said rowing machine on said energy-absorbing suspension apparatus;

a second locating structure configured to permit said energy-absorbing suspension apparatus to be located on a rigid support;

wherein said rowing machine requires no modifications to locate said apparatus under a support member of said rowing machine;

whereby said energy-absorbing suspension apparatus is configured to reduce a reaction force exerted on a user of said rowing machine.

15. The energy-absorbing suspension apparatus of claim 14, whereby the motion on said rowing machine initiated by a rower begins at a forward position, the catch, then moves to a rearward position, the finish, and returns to a forward position, the catch.

16. The energy-absorbing suspension apparatus of claim 15, wherein said energy absorbing component is configured to simulate the behavior of a shell operated on water by adding responsive and compliant roll, pitch, and yaw motions throughout the entire rowing stroke.

17. One or more of said energy-absorbing suspension apparatus of claim 14, in combination with a rowing machine; each of said one or more energy-absorbing suspension apparatus located under a support member of said rowing machine.

18. The energy absorbing apparatus of claim 17 wherein said first locating structure is a cradle that positions a foot of the erg frame; whereby said cradle is connected to an enclosure by means of said energy absorbing components.

19. The energy-absorbing suspension apparatus of claim 14, wherein said energy absorbing component comprises a selected one of an elastomer, a metal, a liquid, a gas, or a composite arrangement made from any combination of these material types.

20. The energy-absorbing suspension apparatus of claim 14, wherein said energy absorbing component comprises a shape selected from one of a tube, a strip, a foam, a ring, a coil spring, a leaf spring, a torsion spring, and a washer spring.

* * * * *